US009470101B2

(12) United States Patent
Landi

(10) Patent No.: US 9,470,101 B2
(45) Date of Patent: Oct. 18, 2016

(54) TURBOMACHINE

(71) Applicant: NUOVO PIGNONE S.p.A., Florence (IT)

(72) Inventor: Giacomo Landi, Florence (IT)

(73) Assignee: NUOVO PIGNONE S.P.A., Florence (IT)

( * ) Notice: Subject to any disclaimer, the term of this patent is extended or adjusted under 35 U.S.C. 154(b) by 901 days.

(21) Appl. No.: 13/690,482

(22) Filed: Nov. 30, 2012

(65) Prior Publication Data

US 2013/0142641 A1 Jun. 6, 2013

(30) Foreign Application Priority Data

Dec. 5, 2011 (IT) ..... CO2011A0058

(51) Int. Cl.

| | |
|---|---|
| ***F01D 9/00*** | (2006.01) |
| ***F01D 11/08*** | (2006.01) |
| ***F04D 29/08*** | (2006.01) |
| ***F01D 11/00*** | (2006.01) |
| ***F04D 29/16*** | (2006.01) |

(52) U.S. Cl.

CPC ..... *F01D 9/00* (2013.01); *F01D 11/001* (2013.01); *F01D 11/08* (2013.01); *F04D 29/162* (2013.01); *F04D 29/167* (2013.01); *F05D 2240/56* (2013.01); *Y10T 29/49245* (2015.01)

(58) Field of Classification Search

CPC .... F01D 11/001; F01D 11/02; F01D 11/003; F01D 11/08; F04D 29/162; F04D 29/167; F16J 15/16; F16J 15/447

USPC ..... 415/173.7, 208.1, 208.2, 208.3, 209.4, 415/211.1; 277/347, 409–416, 418–421

See application file for complete search history.

(56) References Cited

U.S. PATENT DOCUMENTS

| | | | | |
|---|---|---|---|---|
| 3,917,150 | A * | 11/1975 | Ferguson et al. | 228/159 |
| 4,273,510 | A | 6/1981 | Ambrosch et al. | |
| 4,595,207 | A * | 6/1986 | Popp | 277/303 |
| 4,662,820 | A * | 5/1987 | Sasada et al. | 415/173.6 |
| 4,809,990 | A * | 3/1989 | Merz | 277/355 |
| 5,106,104 | A | 4/1992 | Atkinson et al. | |
| 5,201,530 | A | 4/1993 | Kelch et al. | |
| 5,308,088 | A | 5/1994 | Atkinson et al. | |
| 5,318,309 | A | 6/1994 | Tseng et al. | |

(Continued)

FOREIGN PATENT DOCUMENTS

| | | | |
|---|---|---|---|
| CH | 655357 | A5 * | 4/1986 |
| CN | 1057889 | A | 1/1992 |
| DE | 2455195 | A1 | 5/1975 |
| DE | 3425162 | A1 | 1/1986 |
| DE | 3606283 | A1 | 2/1987 |
| DE | 3907614 | A1 | 9/1990 |
| EP | 2154379 | A1 | 2/2010 |
| JP | 54103910 | A * | 8/1979 |
| JP | 2011052645 | A * | 3/2011 |
| JP | 2011106474 | A * | 6/2011 |
| WO | 2004113770 | A2 | 12/2004 |
| WO | WO 2012001995 | A1 * | 1/2012 |

OTHER PUBLICATIONS

Italian Search Report dated Jul. 4, 2012 which was issued in connection with Italian Patent Application No. CO2011A000058 which was filed on Dec. 5, 2011.

Unofficial English translation of Office Action issued in connection with corresponding CN Application No. 201210514057.4 on Jan. 4, 2016.

*Primary Examiner* — Craig Kim

*Assistant Examiner* — Christopher R Legendre

(74) *Attorney, Agent, or Firm* — GE Global Patent Operation; Laura L. Pollander

(57) ABSTRACT

A turbo machine is provided. The turbo machine comprises a turbo stator having a shroud, a turbo rotor having an impeller within the shroud, a brush seal between the impeller and the shroud, and at least one vane extending from the shroud toward the impeller upstream of the brush seal.

17 Claims, 4 Drawing Sheets

(56) References Cited

U.S. PATENT DOCUMENTS

| | | | | |
|---|---|---|---|---|
| 5,330,463 | A | 7/1994 | Hirano | |
| 5,439,347 | A * | 8/1995 | Brandon | 415/121.2 |
| 5,474,305 | A | 12/1995 | Flower | |
| 5,474,306 | A | 12/1995 | Bagepalli et al. | |
| 5,496,045 | A | 3/1996 | Millener et al. | |
| 5,568,931 | A | 10/1996 | Tseng et al. | |
| 5,628,622 | A | 5/1997 | Thore et al. | |
| 5,752,805 | A | 5/1998 | Gail et al. | |
| 6,318,728 | B1 * | 11/2001 | Addis et al. | 277/355 |
| 7,775,763 | B1 * | 8/2010 | Johnson et al. | 415/111 |
| 8,444,379 | B2 * | 5/2013 | Nakaniwa et al. | 415/208.1 |
| 2003/0178778 | A1 | 9/2003 | Szymbor et al. | |
| 2005/0151324 | A1 | 7/2005 | Plona et al. | |
| 2006/0237914 | A1 * | 10/2006 | Li et al. | 277/415 |
| 2013/0142641 | A1 * | 6/2013 | Landi | 415/208.2 |

* cited by examiner

TURBOMACHINE

BACKGROUND OF THE INVENTION

Embodiments of the subject matter disclosed herein generally relate to turbo machines and more particularly, to managing a pressurized process fluid between a shroud and an impeller of a turbo machine.

During the past years, with the increase in price of fossil fuels, the interest in many aspects related to the processing of fossil fuels has increased. During processing of fossil fuels, fluids are transported from on-shore or offshore locations to processing plants for subsequent use. In other applications, fluids may be transported more locally, for example, between sub-systems of a hydrocarbon processing plant to facilitate distribution to end-users.

At least some fluid transport stations use turbo machines, such as compressors, fans and/or pumps that are driven by gas turbines. Some of these turbines drive the associated fluid transport apparatus via a gearbox that either increases or decreases a gas turbine output drive shaft speed to a predetermined apparatus drive shaft speed. In other rotary machines, electrically-powered drive motors, or electric drives are used in place of mechanical drives or in conjunction with mechanical drives (i.e., gas turbines) to operate the rotary machine.

Regardless of the particular setting, i.e. on-shore, offshore, subsea, etc. and regardless of whether the turbo machine is turbine or motor driven, there is an ever present need to increase the efficiency, decrease the costs, and reduce the environmental impact of fossil fuel processing, and in particular, of rotary machines involved in such processing.

As a result of this ever present need, the performance of rotary machines continues to improve. Today's rotary machines are not only faster, more efficient, and environmentally friendly; they are capable of processing more corrosive substance at higher temperatures and higher pressures than ever before.

While these improvements are welcome, existing solutions for controlling these processes are oftentimes inadequate to meet the demands of working in the harsh environments brought about by such improvements.

One area of particular concern is seals. Brush seals are typically provided between the rotor and a stator of a turbo machine to maintain a pressure differential between an upstream and downstream side of the brush seal. Brush seals are vulnerable to diminished performance and potential damage when process fluid bears against the seal with excessive rotational velocity components, oftentimes referred to as excessive process fluid swirl. In the past, process fluid swirl between the rotor and the stator has been addressed through the introduction of so called swirl reducers or swirl brakes positioned upstream of the brush seal. These components typically include circumferential components having axial passages which reduce the swirl in the process fluid traveling through. With increased speed of the rotor, the rotational speed of process fluid swirl also increases. Forcing high speed fluids through such components may contribute to a reduction in the efficiency and/or the performance of the turbo machine.

What is needed is a turbo machine capable of providing improved sealing, reduced process fluid swirl, more uniform speed distribution of the process gas, and improved turbo machine performance.

BRIEF DESCRIPTION OF THE INVENTION

According to an exemplary embodiment, a turbo machine includes a turbo stator having a shroud, a turbo rotor having an impeller within the shroud, a brush seal between the impeller and the shroud, and at least one vane extending from the shroud toward the impeller upstream of the brush seal.

According to another exemplary embodiment, a shroud, impeller, and brush seal assembly in a turbo machine includes at least one vane upstream of the brush seal and extending from a shroud surface towards an impeller of the turbo machine, the at least one vane including an upstream end, a downstream end, a first side extending between the upstream end and the downstream end, and a second side extending between the upstream end and the downstream end, the at least one vane further including an impeller facing surface having an upstream end intersecting the shroud surface and a downstream end intersecting the shroud surface, the impeller facing surface being substantially congruent to the impeller from the upstream end to the downstream end.

According to another exemplary embodiment a method of improving sealing and reducing swirl in a turbo machine includes providing a brush seal between an impeller and a shroud of the turbo machine, providing a cavity between the impeller and the shroud upstream of the brush seal, and providing the cavity with at least one vane extending toward the impeller.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE EXEMPLARY EMBODIMENTS OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a turbo machine that has a stator and a rotor. However, the embodiments to be discussed next are not limited to these exemplary systems, but may be applied to other systems.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
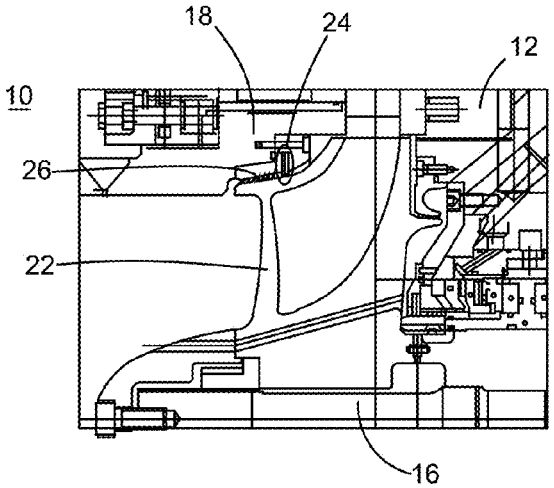
FIG. 1 shows an exemplary embodiment.

FIGS. 1 to 4 show an exemplary embodiment of a turbo machine 10 according to an embodiment of the present invention. Turbo machine 10 includes a high pressure expansion module for an ORC (organic rankine cycle) expander, as shown in FIG. 1. Turbo machine 10 includes a stator 12 having a shroud 18 and a rotor 16 having an impeller 22.

Figure 2:
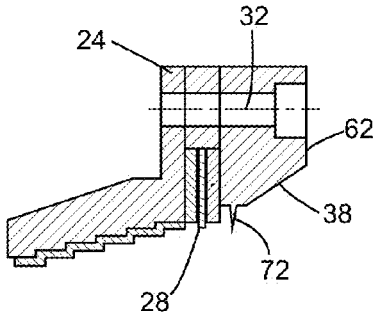
FIG. 2 is a partial cross-sectional view of a brush seal in the exemplary embodiment shown in FIG. 1.

A brush seal 24 (encircled in FIG. 1) and a labyrinth seal 26 are provided between impeller 22 and shroud 18 of turbo machine 10. FIG. 2 shows a partial cross sectional view of brush seal 24 including brush portion 28 and a fastener passageway 32. A threaded fastener may be inserted through each fastener passageway 32 on the periphery of seal 24 to removably secure seal 24 to shroud 18.

Note that the position of brush seal 24 within turbo machine 10, specifically, between shroud 18 and impeller 22, is important since the process fluid swirl speed between impeller 22 and shroud 24 is greater than the process fluid swirl speed between the rotor 16 and stator 18 due to the distal location from the rotor axis.

Figure 3:
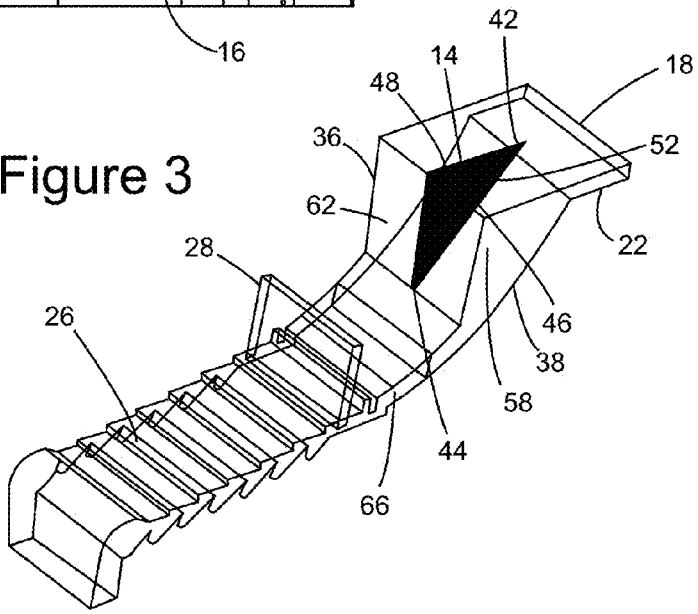
FIG. 3 depicts a partial perspective cross-sectional view of the exemplary embodiment of FIG. 1.
Figure 4:
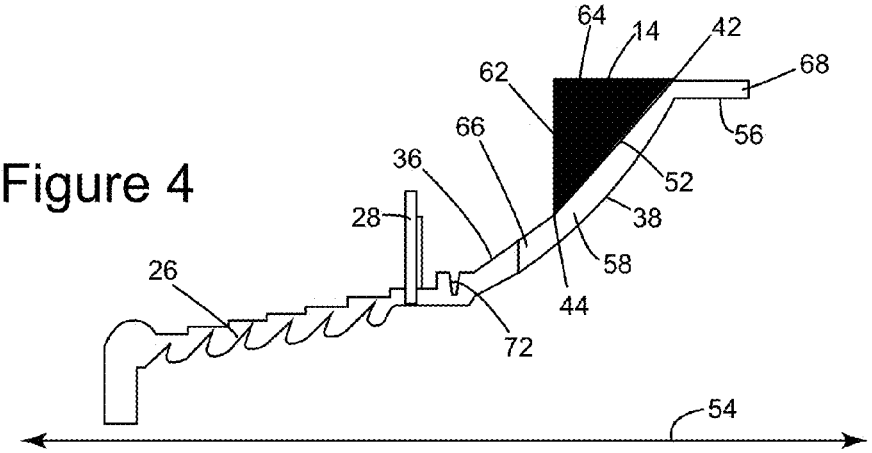
FIG. 4 is another cross-sectional view of the exemplary embodiment shown in FIG. 1.

FIGS. 3 and 4 show a partial view of the shroud 18 and impeller 22 of turbo machine 10. A shroud surface 36 and an impeller surface 38 define a series of cavities through which process fluid travels before bearing against brush seal 24 and then labyrinth seal 26. As shown in FIGS. 3 and 4, a main cavity portion 58 defined by a recessed shroud surface 36 and impeller surface 38 is provided upstream of brush seal 24. At least one vane 14 is provided on shroud 18 within main cavity portion 58. Vane 14 includes an upstream end 42, a downstream end 44, a first side 46 extending between the upstream end 42 and downstream end 44 and a second side 48 extending between the upstream end 42 and the downstream end 44. As further shown in FIGS. 3 and 4, vane 14 further includes an impeller facing surface 52 which intersects shroud surface 36 at upstream end 42 and downstream end 44.

In the exemplary embodiment, vane 14 defines a plane coincident with rotor axis 54 (FIG. 4). Also, as may be appreciated in FIGS. 3 and 4, the upstream end 42 of vane 14 extends radially outwardly beyond the outer diameter 56 of impeller 22.

In the exemplary embodiment of FIGS. 1-4, main cavity 58 is further defined by a planar surface portion 62 which is normal to rotor axis 54. As shown in FIGS. 2 to 4, shroud surface portion 62 is formed by an upstream side of the body of brush seal 24 when the seal is installed to turbo machine 10. Shroud surface 36 also includes a cylindrical surface portion 64 which intersects planer surface portion 62. As shown in FIGS. 1 to 4, vane 14 defines a triangle shape. A first side of the triangle intersects planar shroud surface portion 62, a second side intersects cylindrical surface portion 64 and a third side of the triangular shaped impeller faces impeller 22.

During manufacture, vane 14 may be provided on the body of seal portion 24 at surface 62. During installation of a seal including vane 14, the second side of triangular vane 14 may engage and be secured to cylindrical surface 64. This feature may allow for a vane to be matched or otherwise configured specifically to the characteristics of the brush seal 24 installed to rotary machine 10.

As further shown in FIGS. 1 to 4, main cavity 58 is disposed between a downstream cavity 66 and an upstream cavity 68. Upstream cavity is farther from the rotor axis 54 than the downstream cavity 66. Note that vane 66 extends to downstream cavity 66 as well as to upstream cavity 68.

As shown in FIGS. 3 and 4, upstream cavity 68 is defined by opposing cylindrical surfaces on shroud 18 and impeller 22. Turbo machine 10 further includes a stabilizing tooth 72 extending from shroud surface 36 toward impeller 22. Stabilizing tooth 72 is disposed between brush seal 24 and downstream cavity 66. As may be further appreciated from FIG. 2, tooth 72 is provided on brush seal 24.

Figure 5:
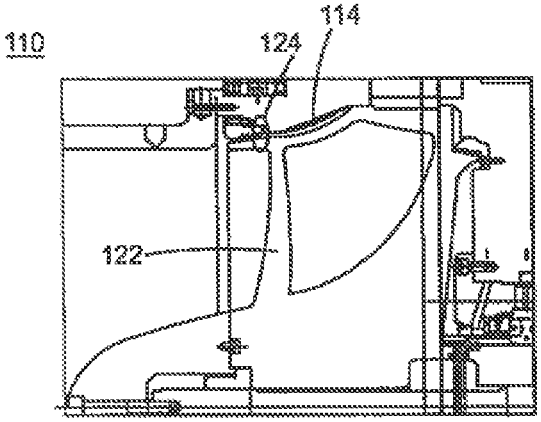
FIG. 5 shows another exemplary embodiment.
Figure 6:
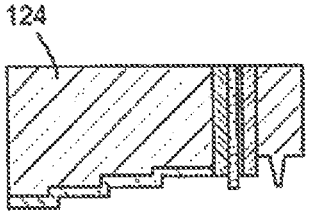
FIG. 6 is a partial cross-sectional view of a brush seal in the exemplary embodiment shown in FIG. 5.

FIGS. 5 to 8 show another exemplary embodiment of a turbo machine 110 according to the present invention. Turbo machine 110 includes a low pressure expansion module for an ORC (organic rankine cycle) expander, as shown in FIG. 5.

Figure 7:
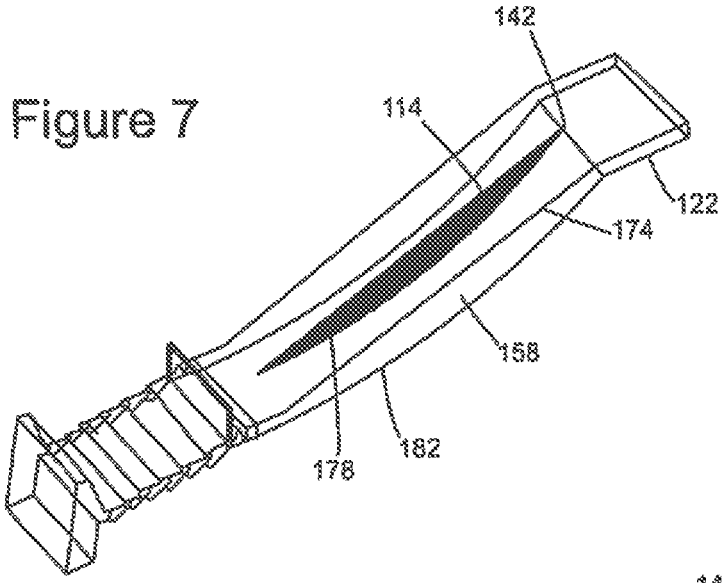
FIG. 7 depicts a partial perspective cross-sectional view of the exemplary embodiment of FIG. 5.
Figure 8:
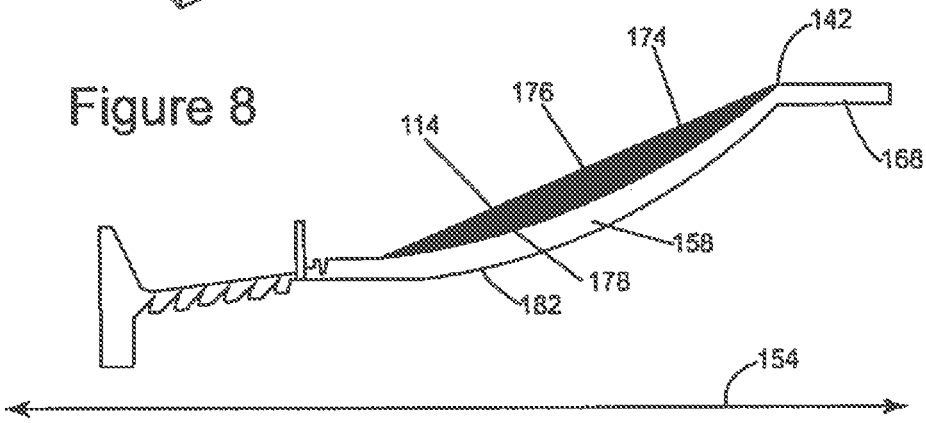
FIG. 8 is another cross-sectional view of the exemplary embodiment shown in FIG. 1.

As shown in FIGS. 7 and 8, main cavity 158 includes a conical shroud surface 174 facing impeller 122. Conical shroud surface 174 tapers in the downstream direction. Vane 114 includes a first side 176 intersecting conical shroud surface 174 and a second side 178 including a surface facing impeller 122. The second side 178 of vane 114 is convex and congruent to a concave surface 182 of impeller 122.

In an analysis of the exemplary embodiment of FIGS. 1 to 4, sixty vanes 14 each having a width of 1 mm were provided within main cavity 58 around rotor axis 54. Also, in an analysis of the exemplary embodiment of FIGS. 5 to 8, ninety vanes 114 were provided within main cavity 158 around rotor axis 154. The analysis indicates that highly swirled flow entering the main cavity 58,158 is deflected by vanes 14, 114 thereby increasing the axial and/or radial velocity flow components while reducing the tangential flow components. The analysis further appears to indicate that swirl is further reduced by a certain amount of viscosity induced momentum dissipation due to the introduction of recirculation regions and highly turbulent flow structures. Moreover, the analysis shows that a uniform velocity distribution of process gas is provided to brush seal 24, 124.

Figure 9:
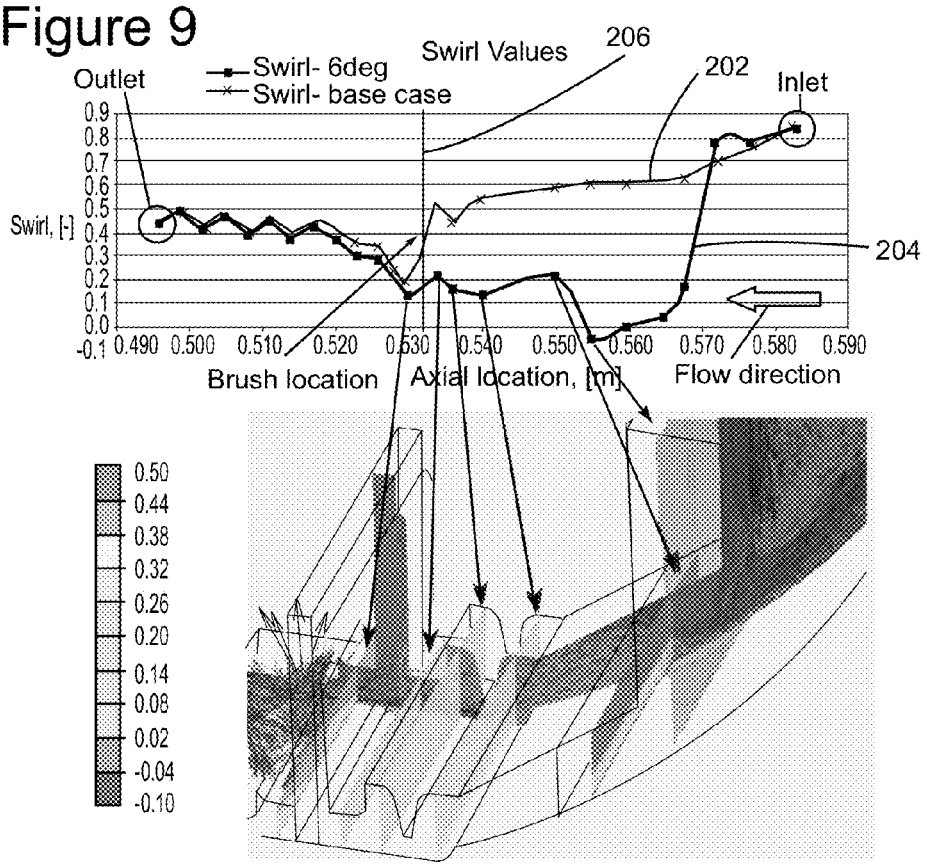
Figure 10:
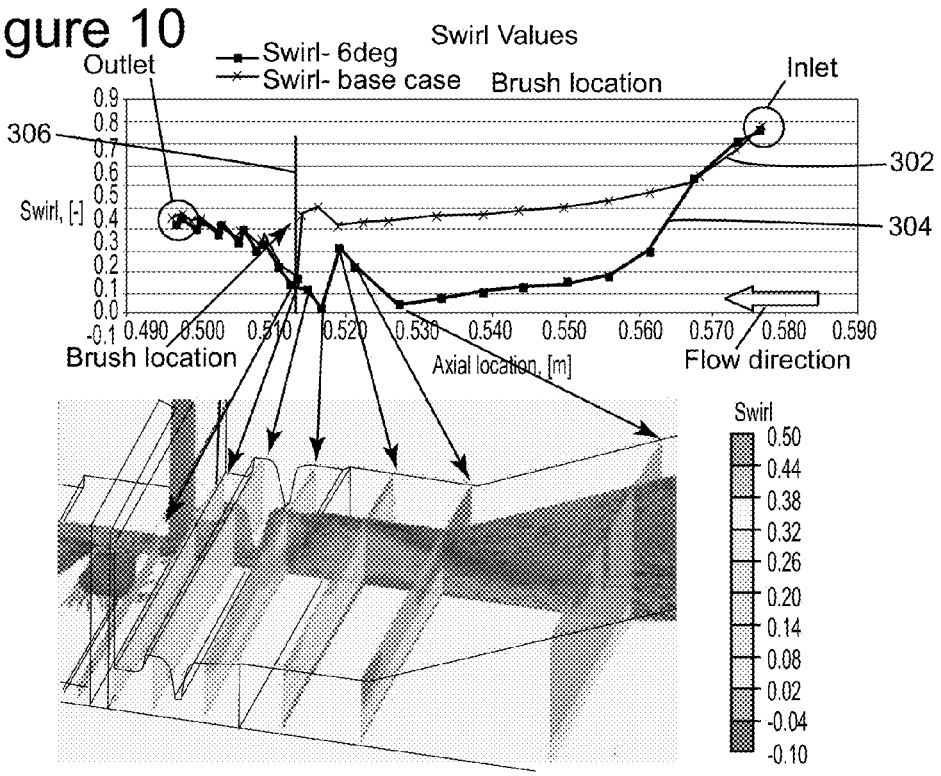
FIG. 10 is an analysis of the exemplary embodiment shown in FIG. 5.

Specifically, FIGS. 9 and 10 show the results of this analysis for the first and second embodiments 10 and 110, respectively. The top of FIG. 9 shows an average swirl number plotted against an axial coordinate from upstream cavity 68 to labyrinth seal 26. The bottom of FIG. 9 shows swirl pattern and meridional velocity fields of a turbo machine 10 including the vanes 14. Line 202 indicates swirl values versus axial location without vanes 14 and line 204 indicates swirl values versus axial location with vanes 14. The location of brush seal 24 is indicated by vertical line 206. As shown in FIG. 9, the swirl value proximate to the upstream side of brush seal 24 without vanes 14 is 0.514 and with vanes 114 the swirl value is 0.221. FIG. 10 shows a similar plot for the second embodiment 110 including line 302 for swirl values versus axial location without vanes 114 and line 304 for swirl values versus axial location with vanes 114. As shown in FIG. 10, the swirl value proximate to the upstream side of brush seal 124 without vanes 114 is 0.471 and with vanes 114, the swirl value is 0.170. Thus, both embodiments provide greater than a fifty percent reduction in swirl value to the process fluid bearing against brush seal 24. As may also be appreciated from the lower portion of FIGS. 9 and 10, turbo machine 10 and 110 provide a uniform speed distribution to the flow of process bearing against seal 24. Accordingly, turbo machine 10, 110 provide improved sealing, reduced process fluid swirl, more uniform speed distribution of the process gas, and improved performance over conventional turbo machines.

Figure 11:
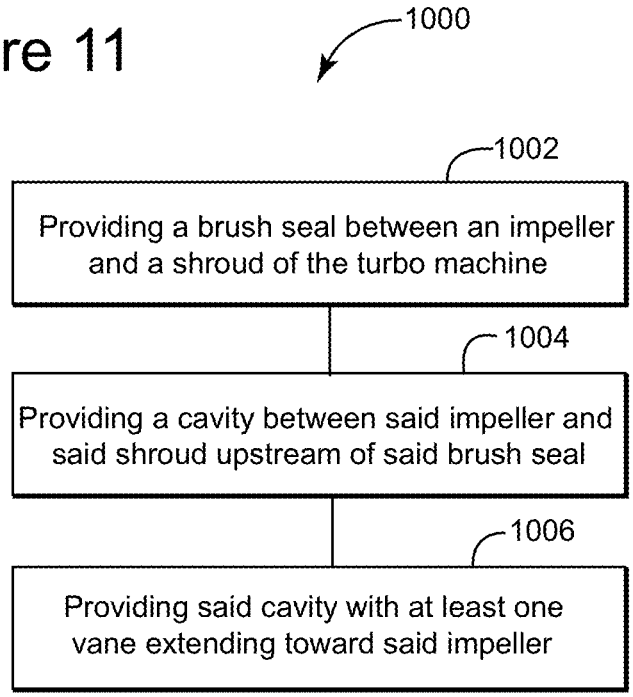
FIG. 11 is a flowchart of a method according to an exemplary embodiment.

According to an embodiment as shown in the flowchart of FIG. 11, a method 1000 of improving sealing and reducing swirl in a turbo machine can include providing 1002 a brush seal between an impeller and a shroud of the turbo machine and providing 1004 a cavity between the impeller and the shroud upstream of the brush seal and providing 1006 the cavity with at least one vane extending toward the impeller.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A turbo machine comprising:
- a turbo stator having a shroud;
- a turbo rotor having an impeller within the shroud;
- a brush seal between the impeller and the shroud;
- a main cavity portion upstream of the brush seal, the main cavity portion being defined by a recessed surface of the shroud and a surface of the impeller;
- at least one vane extending from the shroud towards the impeller being disposed at least partially within the main cavity and upstream of the brush seal; and
- a labyrinth seal arranged downstream of the brush seal between the impeller and the shroud.

2. The turbo machine of claim 1 wherein the at least one vane comprises:
- an upstream end;
- a downstream end;
- a first side extending between the upstream end and the downstream end; and
- a second side extending between the upstream end and the downstream end.

3. The turbo machine of claim 1 wherein the shroud has a surface facing the impeller and the at least one vane comprises an impeller facing surface having an upstream end intersecting the shroud surface and a downstream end intersecting the shroud surface, the impeller facing surface being substantially congruent to the impeller from the upstream end to the downstream end.

4. The turbo machine of claim 1 wherein the at least one vane defines a plane coincident with a rotor axis.

5. The turbo machine of claim 1 wherein the impeller has an outer diameter and the at least one vane extends radially outwardly beyond the outer diameter of the impeller.

6. The turbo machine of claim 1 wherein the recessed surface of the shroud defining the main cavity portion comprises a step defined by a planar shroud surface normal to a rotor axis and a cylindrical shroud surface upstream of the planar shroud surface, the cylindrical shroud surface intersecting the planar shroud surface.

7. The turbo machine of claim 6 wherein the at least one vane defines a triangle shape, a first side of the triangle intersects the planar shroud surface, a second side of the triangle intersects the cylindrical shroud surface, and a third side of the triangle faces the impeller.

8. A shroud, an impeller, and a brush seal assembly in a turbo machine, the assembly comprising:
- at least one vane being disposed at least partially within a main cavity and upstream of the brush seal and extending from a shroud surface towards the impeller of the turbo machine, wherein the main cavity portion is upstream of the brush seal and is defined by a recessed surface of the shroud and a surface of the impeller, the at least one vane comprising:
  - an upstream end;
  - a downstream end;
  - a first side extending between the upstream end and the downstream end;
  - a second side extending between the upstream end and the downstream end; and
  - an impeller facing surface having an upstream end intersecting the shroud surface and a downstream end intersecting the shroud surface, the impeller facing surface being substantially congruent to the impeller from the upstream end of the impeller facing surface to the downstream end of the impeller facing surface; and
- a labyrinth seal arranged downstream of the brush seal between the impeller and the shroud.

9. The assembly of claim 8 wherein the at least one vane defines a plane coincident with a rotor axis.

10. The assembly of claim 8 wherein the impeller has an outer diameter and the at least one vane extends radially outwardly beyond the outer diameter of the impeller.

11. The assembly of claim 8 wherein the recessed surface of the shroud defining the main cavity portion comprises a step defined by a planar shroud surface normal to a rotor axis and a cylindrical shroud surface upstream of the planar shroud surface, the cylindrical shroud surface intersecting the planar shroud surface.

12. The assembly of claim 11 wherein the at least one vane defines a triangle shape, a first side of the triangle intersects the planar shroud surface, a second side of the triangle intersects the cylindrical shroud surface, and a third side of the triangle faces the impeller.

13. A method of improving sealing and reducing swirl in a turbo machine, the method comprising:
- providing a brush seal between an impeller and a shroud of the turbo machine;
- providing a labyrinth seal arranged downstream of the brush seal between the impeller and the shroud;
- providing a cavity between the impeller and the shroud upstream of the brush seal, wherein the cavity is defined by a recessed surface of the shroud and a surface of the impeller; and
- providing the cavity with at least one vane extending towards the impeller.

14. The method of claim 13 wherein the shroud has a surface facing the impeller and the at least one vane comprises an impeller facing surface having an upstream end intersecting the shroud surface and a downstream end intersecting the shroud surface, the impeller facing surface being substantially congruent to the impeller from the upstream end to the downstream end.

15. The method of claim 13 wherein the impeller has an outer diameter and the at least one vane extends radially outwardly beyond the outer diameter of the impeller.

16. The method of claim 13 wherein the recessed surface of the shroud defining the cavity comprises a step defined by a planar shroud surface normal to a rotor axis and a cylindrical shroud surface upstream of the planar shroud surface, the cylindrical shroud surface intersecting the planar shroud surface.

17. The method of claim 16 wherein the at least one vane defines a triangle shape, a first side of the triangle intersects the planar shroud surface, a second side of the triangle intersects the cylindrical shroud surface, and a third side of the triangle faces the impeller.

* * * * *